US007944072B2

(12) United States Patent
McKie

(10) Patent No.: US 7,944,072 B2
(45) Date of Patent: May 17, 2011

(54) HIGH-RISE BUILDING HYDRO-ELECTRIC CO-GENERATION DEVICE AND METHOD

(76) Inventor: James McKie, Downey, CA (US)

( * ) Notice: Subject to any disclaimer, the term of this patent is extended or adjusted under 35 U.S.C. 154(b) by 0 days.

(21) Appl. No.: 12/150,273

(22) Filed: Apr. 25, 2008

(65) Prior Publication Data

US 2009/0267350 A1 Oct. 29, 2009

(51) Int. Cl.
*F03B 13/00* (2006.01)

(52) U.S. Cl. ..... 290/52; 290/43; 290/54

(58) Field of Classification Search ..... 290/54, 290/52, 43

See application file for complete search history.

(56) References Cited

U.S. PATENT DOCUMENTS

| | | | | |
|---|---|---|---|---|
| 4,352,025 | A | 9/1982 | Troyen | |
| 4,843,249 | A | 6/1989 | Bussiere | |
| 4,868,408 | A | 9/1989 | Hesh | |
| 4,918,369 | A | 4/1990 | Solorow | |
| 5,905,312 | A | 5/1999 | Liou | |
| 5,988,991 | A | 11/1999 | Tsai | |
| 6,051,892 | A | 4/2000 | Toal, Sr. | |
| 6,412,281 | B2 | 7/2002 | Cover | |
| 6,448,669 | B1 | 9/2002 | Elder | |
| 7,233,078 | B2 * | 6/2007 | Baarman et al. | 290/43 |
| 7,579,703 | B2 * | 8/2009 | Shifrin | 290/52 |

* cited by examiner

*Primary Examiner* — Nicholas Ponomarenko
*Assistant Examiner* — Iraj A Mohandesi
(74) *Attorney, Agent, or Firm* — Michael A. Shippey

(57) ABSTRACT

A method and a device are disclosed which are capable of collecting water at a high point of a high-rise building. The water can be stored until used. The water is allowed to run down by gravity past a hydroelectric generator to generate electricity for the occupants of the building, or for some other use. The water after use is discarded to the public drain.

8 Claims, 3 Drawing Sheets

HIGH-RISE BUILDING HYDRO-ELECTRIC CO-GENERATION

HIGH-RISE BUILDING HYDRO-ELECTRIC CO-GENERATION DEVICE AND METHOD

BACKGROUND OF THE INVENTION

1. Field of the Invention

This invention relates generally to the field of hydroelectric power generation. More specifically, it relates to localized generation and use of small-scale hydroelectric power.

2. Scope of Prior Art

Hydroelectric power generation, of course, has been known for a long time. Devices for converting water power to electrical power are highly developed for large scale applications, such as at dam sites.

Usually, such power generation is very dependent on geography, and in fact is often found in remote places that have waterfalls, running water, or other sources of hydrodynamic energy that can be converted to electrical power.

Less well known are methods of converting water power to electrical power that are suitable for small scale operations, and for local sites close to urban centers or working office buildings. It is this need that the current invention is designed to address.

SUMMARY OF THE INVENTION

The method of this invention uses hydro energy, from an artificial precipitation collection system, to generate local electrical power for local use.

The device of this invention is a collection of water collection columns that extend vertically from the ground floor or basement of a high-rise building up to the roof. The tops of the columns are open to collect rainwater. The columns are connected at the bottom to a manifold system that, on demand, sends gravity-energized water to a hydroelectric generator.

An object of this invention is to provide a localized electrical energy supply from environmentally friendly sources.

Another object of this invention is to provide storage for potential energy that can be converted to localized electrical energy.

This invention has many significant applications. The applications described herein are just a few of the ones anticipated, and are these are not intended to be limiting. There are numerous other applications and opportunities for this invention. Other uses and features of the current invention will become apparent from the following description of the preferred embodiment in the detailed written specification and accompanying drawings.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention. It is further to be understood that the drawings are provided for purposes of illustration and description, and are not to be construed as limiting this invention.

There is one Table of calculations in the specification, at the end thereof.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as representative basis for teaching one skilled in the art of micro aperture formation to employ the present invention in virtually any appropriately detailed system, structure, or manner.

Figure 1:
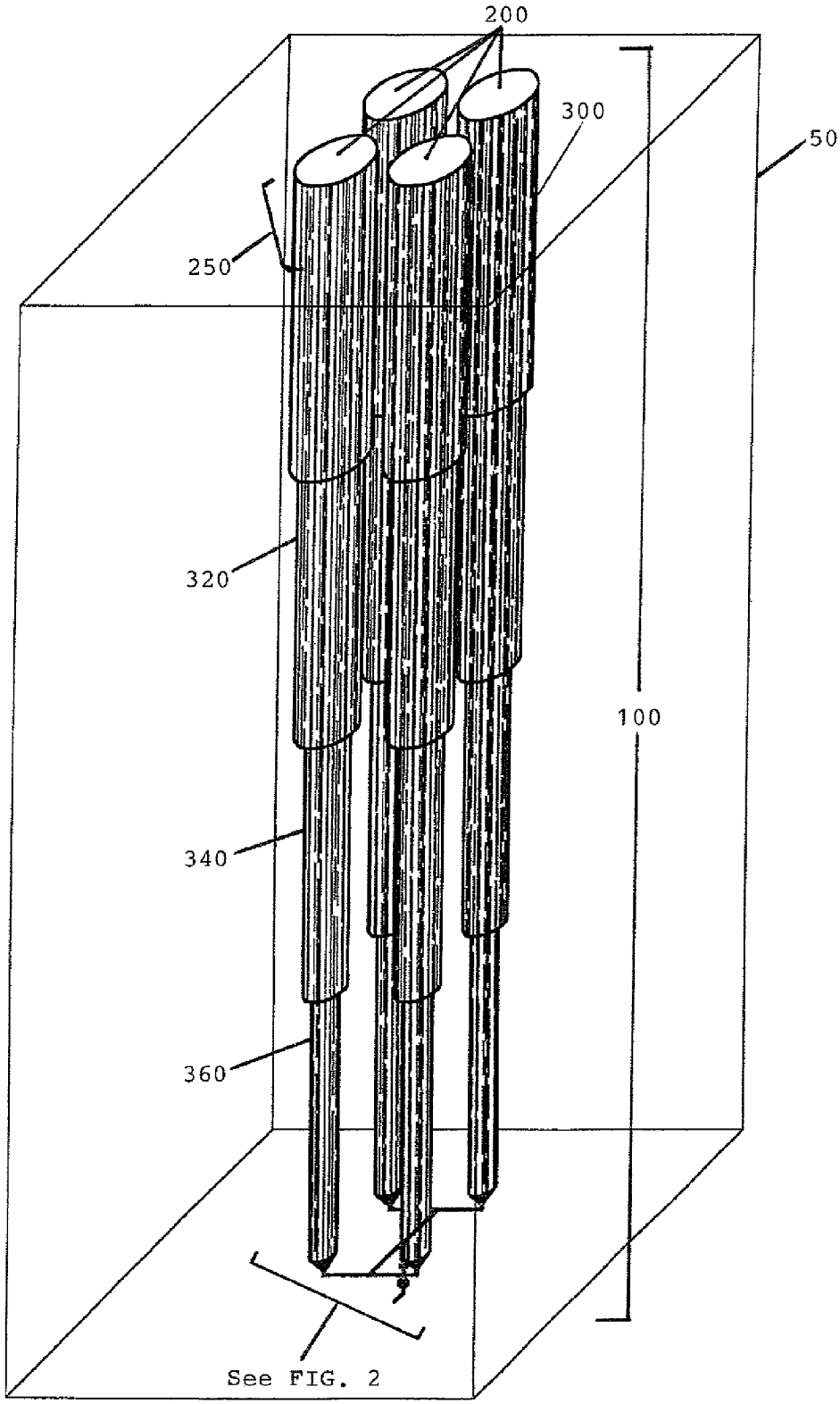
FIG. 1 is a schematic drawing of the entire assembly of this invention from a perspective view.

FIG. 1 is a schematic drawing showing an upper perspective view of the entire assembly of this invention 100. The assembly is shown constructed of four columns 250. The columns are shown vertically disposed, within a high-rise building 50. The building itself is not contemplated as a part of the current invention. Indeed, it is contemplated that existing buildings can be retrofitted with the current invention 100.

Each column has an open top 200 in the top of the column, atop the largest section 300. These largest sections in one preferred embodiment of the current invention are each 300 feet long, and 30 feet in diameter. Each such section can hold up to 212,000 cubic feet of water when full. Lower column sections possess shorter diameters, and corresponding smaller volumes; but each column segment is 300 feet long, wherever it appears in the column, in this preferred embodiment.

Next in line below the upper section 300 in each column is a mid-upper section 320. This section, although also 300 feet long, is only 24 feet in diameter, and holds when full over 135,700 cubic feet of water.

Following below the upper two sections in each column is a mid-lower section 340. This section, although also 300 feet long, is only 16 feet in diameter, and holds when full over 80,300 cubic feet of water.

Finally, at the lower end of each column is a lower section 360. This section, although also 300 feet long, is only 10 feet in diameter, and holds when full almost 24,000 cubic feet of water.

The top of the upper section 300 in each column can be opened to admit rainwater, or closed to prevent the admission of water. This allows an operator of the present invention to balance the water stored in the columns. Similarly, at the bottom of each column is a control valve, which can be closed to store water in the column, or open to allow water to run out into the manifold system, ultimately leading to the electricity generation unit.

Each column, when all sections are full of water, will hold over 431,000 cubic feet of water. The total for four columns is 1,726,618 cubic feet of water. The calculations involved in obtaining these numbers are shown in Table I, found at the end of this document.

Figure 2:
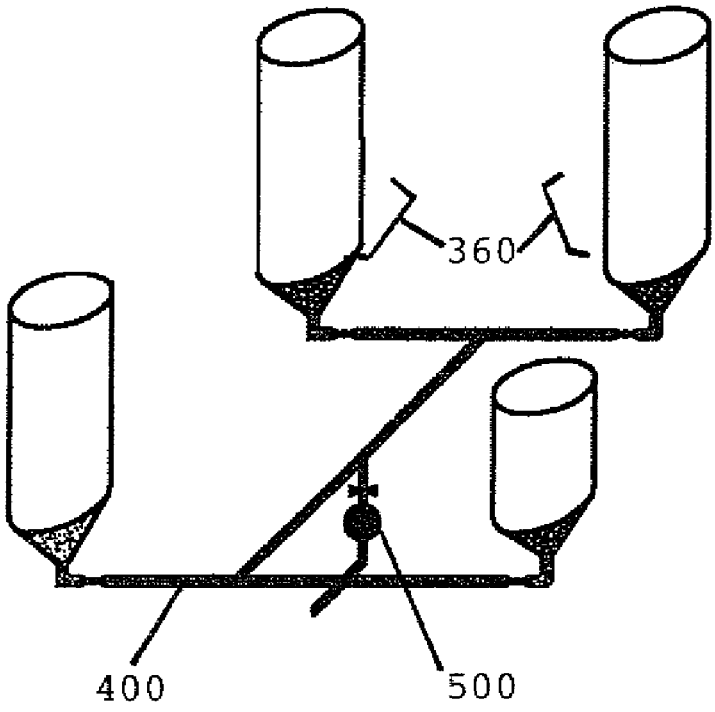
FIG. 2 is a magnified drawing of the lower column sections, showing the connection to the manifold assembly.

FIG. 2 shows the connection between the lower ends of the columns 360 and manifold 400. Along manifold 400 (not shown) are control valves to allow water to flow from each of the columns, or to shut off the water flow from any desired column or columns.

Figure 3:
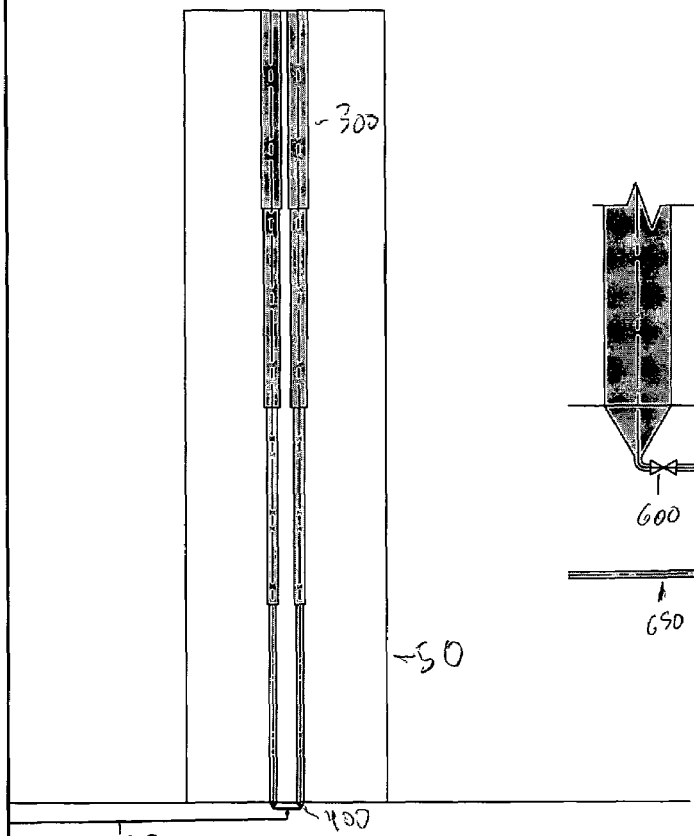
FIG. 3 is a drawing of the columns of this invention from a plan view.

FIG. 3 is a schematic diagram of the entire assembly of this invention from a plan side view. Essentially the same elements are shown as in FIG. 1. The manifold 400 is also in evidence, as is drain line 650, leading to the storm drain.

Note that it is important that the columns have the telescope-like configuration of larger volume sections at the top, and smaller volume sections at the bottom. This is to ensure that the bulk of the water remains elevated, and thus in possession of large amounts of potential energy. This energy will translate to electricity at the bottom of the columns, when the water is sent to a hydroelectric generator. This could be one generator, or a system of individual generators.

The actual electrical generation occurs as the water, flowing out of the bottom of a column, flows through the manifold and through a hydroelectric generator system. Such generators are well known in the art. One supplier of such generators is: NoOutage.com LLC, who can be located on the Internet at NoOutage.com.

Figure 5:
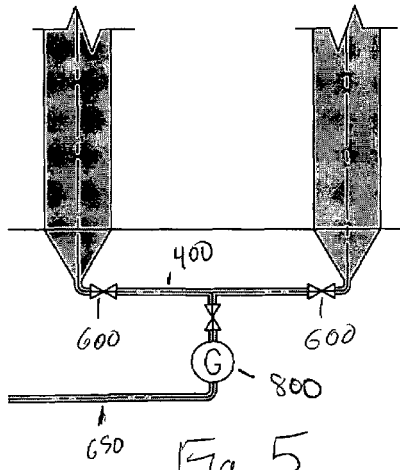
FIG. 5 is a drawing of the lower ends of the columns of this invention, their connection to a manifold system, and the hydroelectric generator site.

FIG. 5 shows a schematic plan view of the bottom of two columns, with control valves 600 shown for each column. Manifold 400 conducts the water to the hydroelectric generation system, indicated at 800. The water, after use to generate electricity, then is expelled down line 650 to the storm drain.

While the invention has been described in connection with a preferred embodiment or embodiments, it is not intended to limit the scope of the invention to the particular form set forth, but on the contrary, it is intended to cover such alternatives, modifications, and equivalents as may be included within the spirit and scope of the invention as defined by the appended claims.

TABLE I

| CALCULATIONS FOR WATER/POWER STORAGE | | | | |
|---|---|---|---|---|
| 1) ANNUAL RAIN COLLECTED | ON ROOF OF 300' × 300' BLDG. @ 20' RAIN/YEAR 300 * 300 * 20 | 1800000 CF | | |
| 2) FORMULA FOR HYDRO POWER | GROSS HEAD × FLOW × SYSTEM EFFICIENCY × C = POWER (KW) (EXAMPLE: 20' × 2CFS × .55 × .085 = 1.9 KW) | | | |
| 3) VOLUME OF EACH OF FOUR WATER COLUMNS | 1726618/4 | 431655 CF | | |
| 4) POTENTIAL POWER OF BUILDING 300' × 300' × 1200', BASED ON 100 HRS. OF USAGE PER YEAR | | | | |
| 100 * 60 * 60 | 360000 SECONDS IN 100 HRS. | | | |
| 1800000 CU. FT./360000 SECONDS | 5 CFS | | | |
| 5) FORMULA FOR HYDRO POWER | GROSS HEAD × FLOW × SYSTEM EFFICIENCY × C = POWER (KW) | | | |
| | 1200 * 5 * 0.7 * 0.085 | 357 KW | | |
| | (ASSUME MAX EFFICIENCY OF .7 W/HIGH HEAD) | | | |
| | 357 KW FOR 100 HOURS, 35.7 KW FOR 1000 HOURS, ETC. | | | |
| pi * radius$^2$ * height | CALCULATIONS FOR VOLUME OF EACH WATER COLUMN USING FORMULA FOR VOLUME OF A CYLINDER | | | |
| WATER COLUMNS - DIMENSIONS IN FT. | | | | |
| 30 × 1200 | 848230 | 848230/4 | 212057.5 | |
| 24 × 1200 | 542867 | 542867/4 | 135716.8 | |
| 16 × 1200 | 241274 | 241274/4 | 60318.5 | |
| 10 × 1200 | 94247 | 94247/4 | 23561.75 | |
| TOTAL VOLUME - CUBIC FEET | 1726618 | 1726618/4 | 431654.5 | 431654.5 |

1) EXAMPLE: A BUILDING 300' × 300' × 1200'. BUILT INTO THE STRUCTURE WILL BE FOUR WATER COLUMNS, EACH MADE UP OF FOUR SECTIONS OF THE FOLLOWING DIMENSIONS: 30' × 300', 24' × 300', 16' × 300' & 10' × 300' (PLACE COLUMNS IN THE CENTER OF THE BUILDING, FORMING A SQUARE)

2) THE SECTIONS OF EACH COLUMN WILL BE ARRANGED FROM TOP TO BOTTOM IN DESCENDING ORDER OF DIAMETER, WITH REDUCING COLLARS BETWEEN EACH SECTION. THIS FEATURE WILL STRESS STORING THE MAJORITY OF THE POWER (WATER) AT THE GREATEST HEIGHT. THIS WILL ALSO FACILITATE ENGINEERING THE PROJECT - THE NARROWEST SECTION (BOTTOM) OF EACH COLUMN WILL HAVE TO WITHSTAND THE MOST PRESSURE AND THE WIDEST SECTION (TOP) WILL HAVE TO WITHSTAND THE LEAST PRESSURE.

3) DEPICT AT THE ROOF-TOP OF THE BUILDING A SYSTEM TO MANIFOLD THE INLET OF RAINWATER INTO THE FOUR WATER COLUMNS SO THAT EACH COLUMN HAS ITS OWN INLET VALVE - FOR MAINTENANCE & TO ACCOMMODATE LOAD REQUIREMENTS DEPICT IN THE BASEMENT OF THE BUILDING A SYSTEM TO MANIFOLD THE OUTFLOW OF RAINWATER THROUGH THE HIGH-SPEED, HIGH-HEAD HYDROELECTRIC GENERATOR SO THAT EACH COLUMN HAS ITS OWN OUTLET VALVE - FOR MAINTENANCE & TO ACCOMMODATE LOAD REQUIREMENTS

Figure 4:
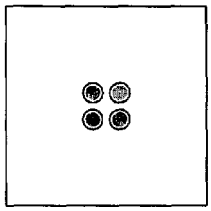
FIG. 4 is a drawing of the columns of this invention from a top view, above the roof of the building.

FIG. 4 shows a top view of the water columns as visible above the roof of an office building. Here, when the tops are open, the columns can collect rainwater. The rainwater can be stored in the columns, until released at the control valves to power the hydroelectric generator. Algicide or other inhibitors are optionally added to the columns to prevent growth of algae or other unwanted contaminants. Alternatively, the columns can be used as a water source for emergency purposes. More conveniently, water can be withdrawn at desired intervals for storage, and if necessary, treatment for purposes of providing drinking water. Such uses will not be expected to remove significant amounts of water, which will be needed for electricity generation.

I claim:

1. A device for collecting water and producing electricity, comprising:

a. A plurality of vertical hollow columns, each open at the top end;

b. Each said column being comprised of several sections;

c. The bottom section of each said column being connected to a manifold;

d. A hydroelectric generator;

e. Said manifold so configured as to conduct water in the columns to said hydroelectric generator; and, f. An outlet pipe to conduct wastewater away from said columns.

2. The device of claim 1, further comprising a plurality of outlet control valves.

3. The device of claim 2, wherein each column is associated with a control valve.

4. The device of claim 1, wherein the diameter of each column increases sectionally from the bottom section to the top section.

5. The device of claim 1, further comprising a water level measuring device.

6. The device of claim 1, further comprising controlling means to control the outlet valves.

7. The device of claim 1, wherein the device is configured to be contained inside a multi-story commercial building.

8. A method to co-generate electricity, comprising the steps of:

a. Collecting water in the device of claim 1;

b. Channeling the collected water to a hydroelectric generator;

c. Operating said generator so as to generate electricity; and, d. Disposing of the waste water by sending it to the public drain system.

* * * * *